United States Patent [19]

Haglund

[11] 4,111,254

[45] Sep. 5, 1978

[54] METAL CASTING METHOD

[75] Inventor: John Helge Haglund, Danbury, Conn.

[73] Assignee: The Kanthal Corporation, Bethel, Conn.

[21] Appl. No.: 711,320

[22] Filed: Aug. 3, 1976

[51] Int. Cl.[2] ..... B22D 3/00

[52] U.S. Cl. ..... 164/138; 164/363; 164/409; 249/112; 249/137; 249/174

[58] Field of Search ..... 164/138, 363, 125, 127, 164/409; 249/112, 137, 174, 109

[56] References Cited

U.S. PATENT DOCUMENTS

| | | | |
|---|---|---|---|
| 1,073,988 | 9/1913 | Hoyle et al. | 164/363 X |
| 4,033,401 | 7/1977 | Wlodawer | 164/127 X |

FOREIGN PATENT DOCUMENTS

| | | | |
|---|---|---|---|
| 1,071,386 | 8/1954 | France | 249/174 |
| 458,342 | 4/1928 | Fed. Rep. of Germany | 249/174 |
| 1,178,557 | 9/1964 | Fed. Rep. of Germany | 164/363 |
| 139,081 | 2/1953 | Sweden | 164/138 |

*Primary Examiner*—Robert L. Spicer, Jr.
*Attorney, Agent, or Firm*—Kenyon & Kenyon, Reilly, Carr & Chapin

[57] ABSTRACT

A high melting temperature metal, casting mold is made of sheet metal embedded in a supporting mass of refractory particles preventing deformation of the sheet metal under the weight of the cast metal and conducting heat from the sheet metal at a rate preventing complete melting of the sheet metal.

5 Claims, 8 Drawing Figures

METAL CASTING METHOD

BACKGROUND OF THE INVENTION

Customarily, molten metal having a melting temperature in the area bove 1,400° C. is cast into ingot molds and permitted to solidify in the form of ingots which are then reheated and rolled to desired shapes and cross-sectional dimensions. The ingot molds are made of cast iron and have thick walls. Such a mold during its service life tends to develop cracks on its inside surface and requires replacement if ingots having good surfaces are to be produced. These heavy cast iron ingot molds are expensive and difficult to manipulate.

It is impractical to make such ingot molds in small cross-sectional sizes. Therefore, the ingots they produce are of correspondingly large cross-sectional size and require undesirably extensive rolling to reduce them to the desired extent. The reheating of such large ingots, required for their rolling, is slow and expensive.

Heretofore it has been believed to be impossible to reduce the wall thickness of such cast iron ingot molds because their service life has been believed to be a function of the ratio of mold weight to ingot weight.

The continuous steel casting practice eliminates the need for using heavy cast iron ingot molds but requires extremely expensive machinery. This practice is limited to large steel producers.

SUMMARY OF THE INVENTION

Contrasting with the use of such thick-walled cast iron ingot molds, the present invention is an ingot mold made of thin sheet metal embedded in a supporting mass of refractory particles. For most purposes the sheet metal forms a vertically elongated cavity for holding the previously characterized molten metal during its casting and solidification.

For example, one or more vertical pipes fabricated from plain carbon can be used, supported by a mass of sand packed around the pipe or pipes with the sand supported by a suitable container which may itself be made of sheet metal if of adequate thickness to have the rigidity required to hold the sand. The pipe material can be any thin sheet metal and its thickness need only be great enough to resist indentation by the sand particles. The pipe diameter may be made conveniently small.

Surprisingly, it has been found that this new mold concept is satisfactory for the casting of metal having the high melting temperatures of 1400° C. and usually substantially higher. An alloy suitable for the ultimate production of electric resistance heating wire, has been successfully cast to ingots in this new mold. If there is enough sand radially with respect to the pipe or pipes, the heat of the cast molten metal is carried away so rapidly by conduction through the sand as to prevent any substantial melting of the sheet metal.

Because sheet metal as normally produced provides a very smooth surface and is inherently free from cracking at high temperatures, the resulting ingots produced are free from surface defects. Because of the low cost of sheet metal, the molds can be made with small cross-sectional dimensions and considered as expendable parts.

It is unnecessary to remove the sheet metal from the ingots produced by this invention. When the sheet metal is, for example, plain carbon steel, and the ingots are reheated for rolling, under ordinary oxidizing conditions, the sheet metal mold part or skin oxidizes to form a scale on the ingot. Reheated steel ingots and billets normally carry such a scale on their surfaces.

BRIEF DESCRIPTION OF THE DRAWINGS

An example of the present invention as it has been used to cast high alloy ingots having a composition suitable for rolling and ultimate wire drawing into electric resistance heating wire, is schematically illustrated by the accompanying drawings, in which.

DETAILED DESCRIPTION OF THE INVENTION

Figure 1:
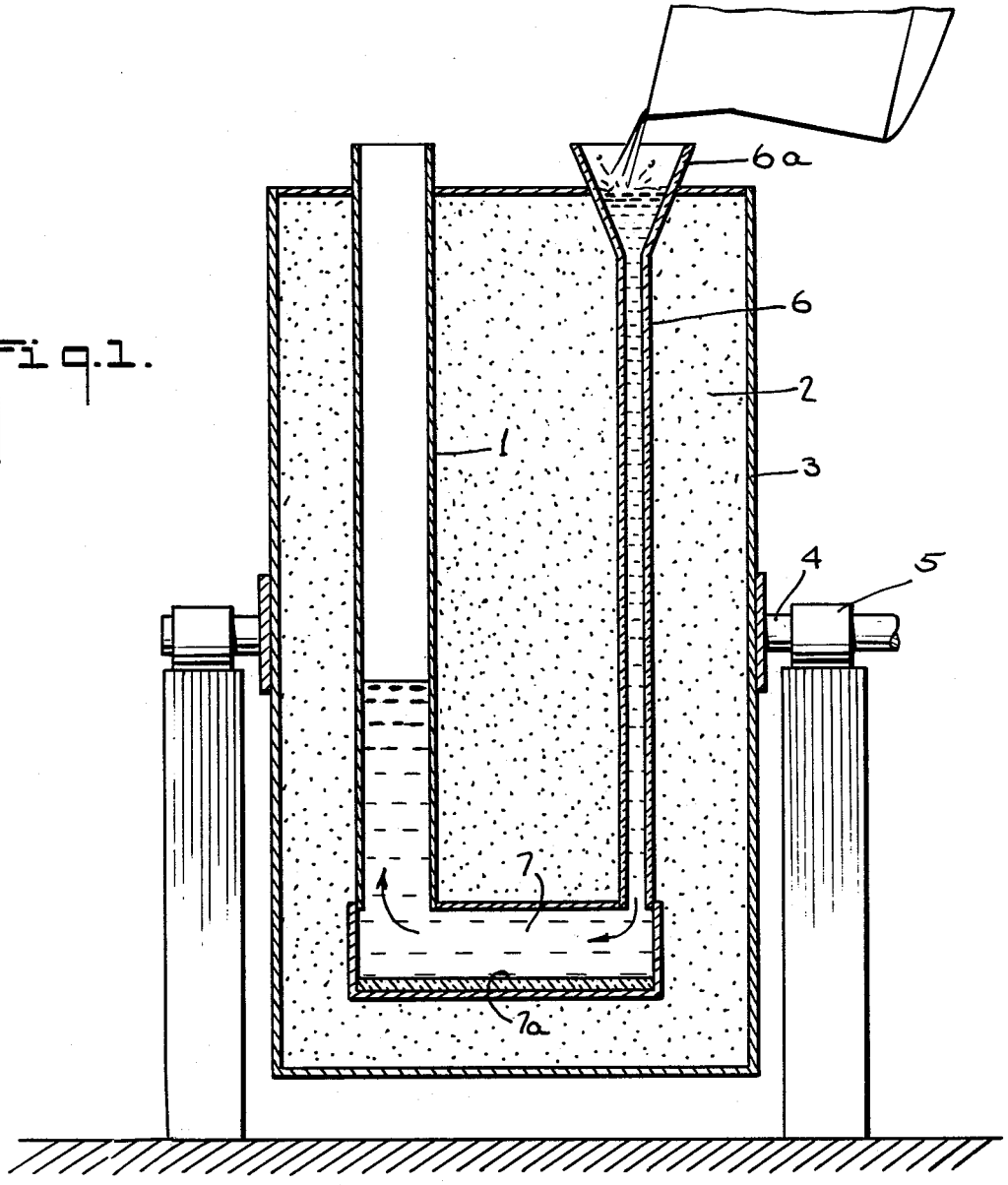
FIG. 1 is a vertical section of a single ingot mold showing the bottom pouring of the molten metal into the roll, the mold being invertable as explained hereinafter.
Figure 2:
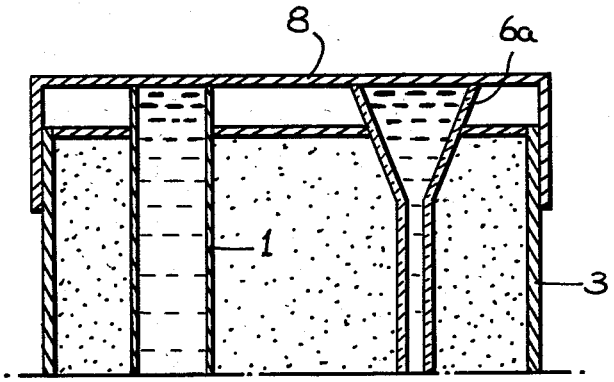
FIG. 2 shows only the top portion of FIG. 1 with a closure applied for holding the metal during inversion of the mold.

FIG. 1 shows the vertically elongated sheet metal pipe 1 embedded in the sand 2 which is contained in a metal drum 3 having trunions 4 supported in fixed bearings 5. The container 3 can be inverted by rotation on its trunions 4.

The sheet metal pipe 1 can be made of plain carbon steel sheet with a gauge providing a thickness in the area of 0.0209 inch. The pipe can be made by bending and seaming a flat sheet. Other sheet metal can be used. The sheet thickness need only be great enough to avoid deformation by the sand particles when packed around the pipe.

Although a fine-grained sand has been used, any relatively fine-grain particles of any refractory can be used.

Incidentally, in the actual practice of this invention a plurality of the pipes 1 have been embedded in the sand 2.

For bottom pouring, a ceramic fountain 6 is shown embedded in the sand 2 with its runner 7 enlarged so that this runner forms a metal reservoir connecting with the open bottom of the sheet metal pipe 1. This runner or reservoir 7 can also be made of ordinary sheet steel but is preferably provided with a refractory bottom layer shown at *7a*.

For casting, a melt of electric resistance heating wire alloy was poured into the funnel *6a* of the fountain 6, the metal filling the reservoir 7 and rising in the pipe 1 until the latter and the funnel were completely filled, their tops being at the same level.

Figure 3:
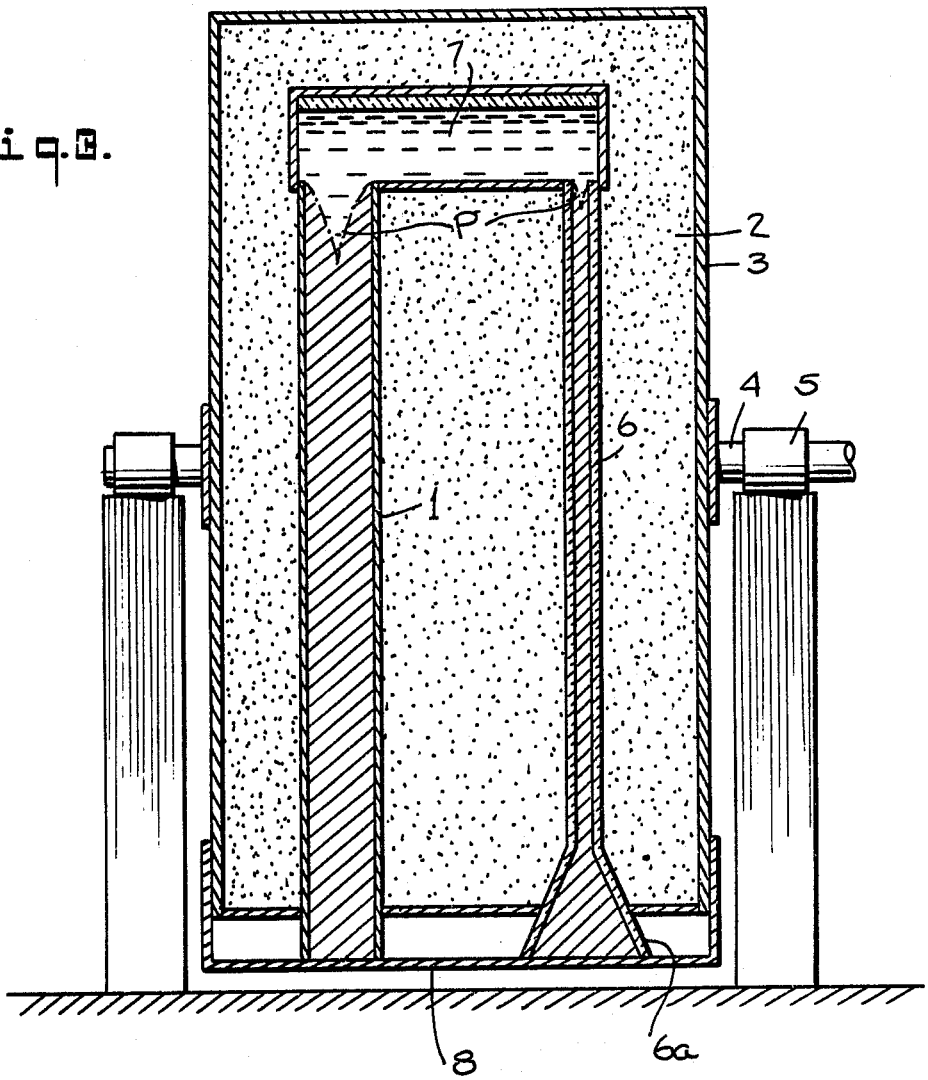
FIG. 3 in vertical section, shows the mold inverted.
Figure 4:
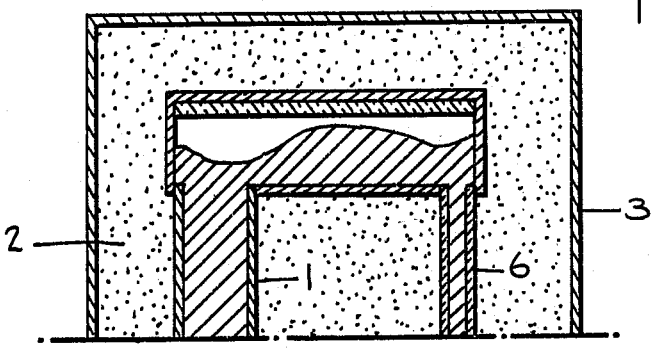
FIG. 4 shows the top portion of FIG. 3, after the solidification of the molten metal.
Figure 5:
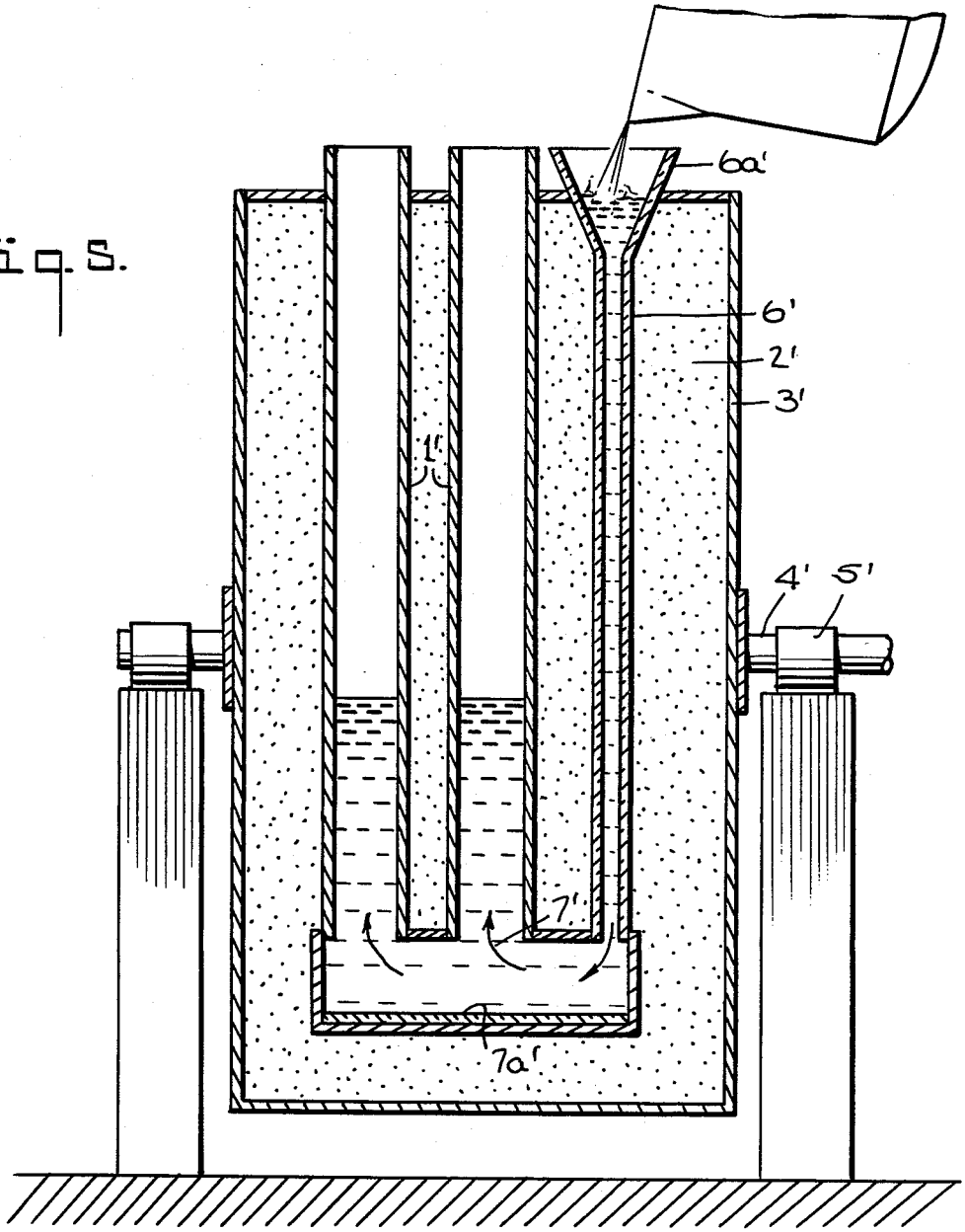
FIG. 5 corresponds to FIG. 1 but shows a plurality of the ingot molds in use.
Figure 6:
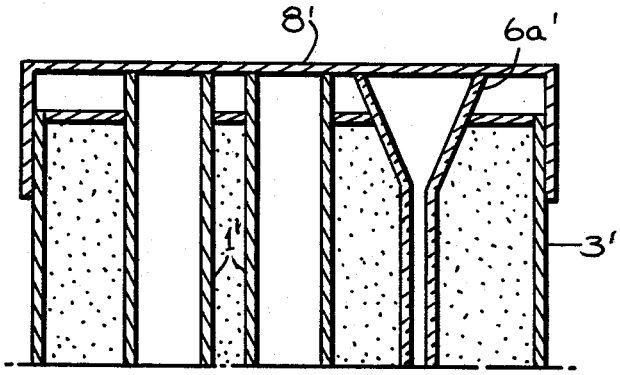
FIG. 6 corresponds to FIG. 2 excepting that it shows the top portion of FIG. 5.
Figure 7:
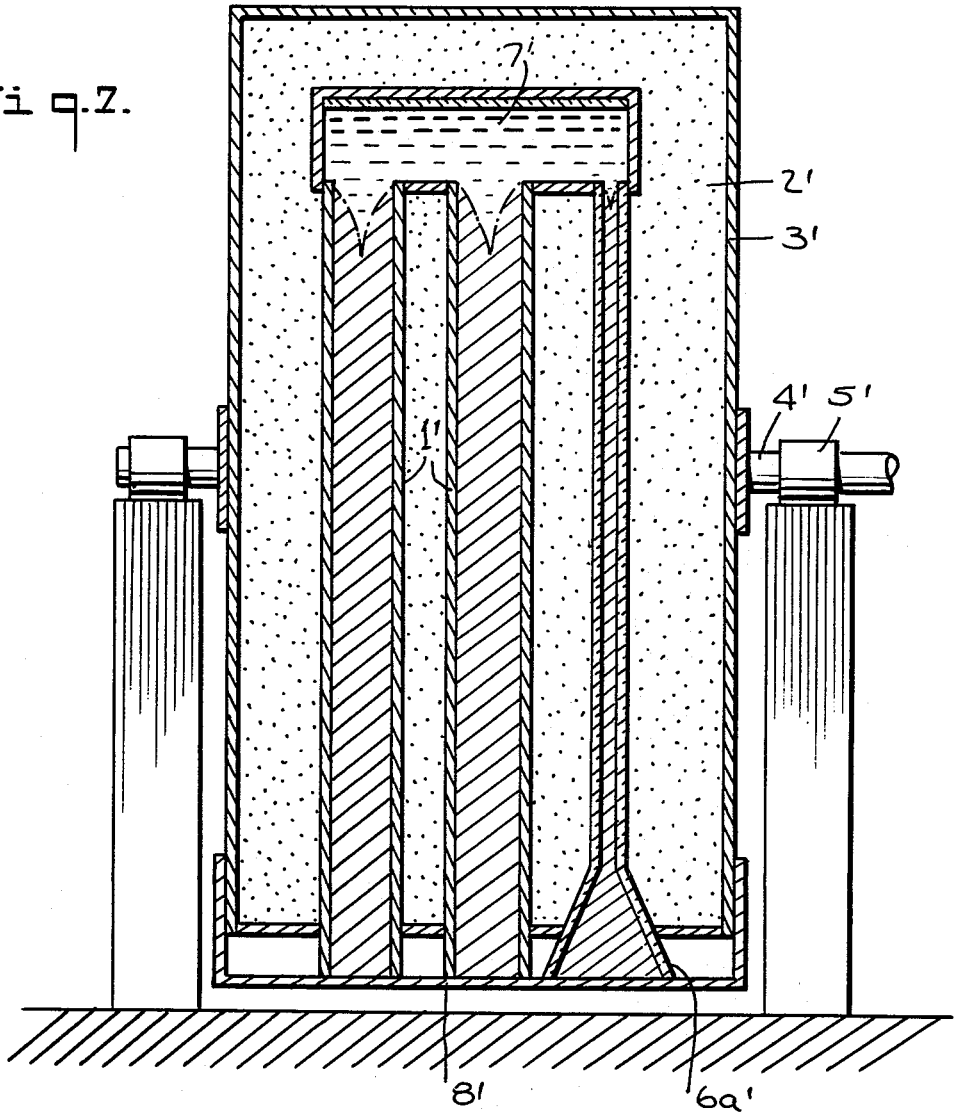
FIG. 7 corresponds to FIG. 3 excepting for using the plurality of molds.
Figure 8:
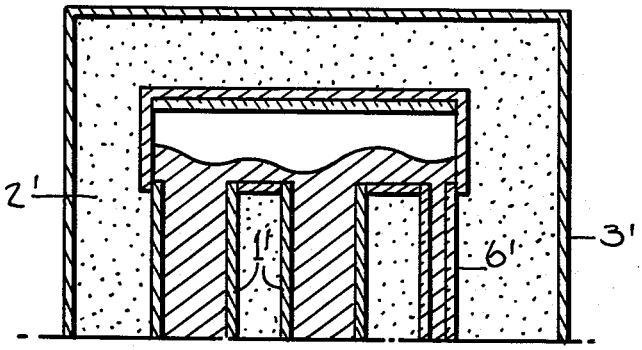
FIG. 8 is like FIG. 4 excepting for the use of the plurality of molds.

Next, a cover 8 was applied to close the top of the mold and funnel, the mold then being inverted as shown by FIG. 3. During solidification the cast metal tended to pipe as indicated at P in FIG. 3 but this was prevented or remedied by the metal in the reservoir 7. This reservoir is itself embedded in the sand but its held metal is shielded from the sand by the refractory *7a*. Also, the metal in the reservoir 7 is necessarily hotter than the metal that had to leave the reservoir and rise upwardly into the pipe during the casting operation. For these reasons, the metal in the reservoir 7 remains liquid during the freezing of the metal in the sheet metal pipe 1. After the solidification the metal in the reservoir had the appearance represented by FIG. 4.

After solidification of the ingot, it was only necessary to remove the cover 8 so that everything could be dumped out of the outer container 3. The ingot can be easily removed from the mass of metal that solidified in the reservoir 7. The sheet metal adheres to the resulting ingot and is externally continuous and free from any sign of melting.

It can be seen that the present invention eliminates the expense and inconvenience of heavy cast iron molds; it makes practical the production of ingots of small cross-sectional dimensions; ingots free from surface imperfections can be produced.

As previously indicated, one or more of the sheet metal pipes can be used and, as also mentioned previously, in the actual practice of this invention a plurality of the pipes 1 have been embedded in the sand 2.

This use of a plurality of the pipes is illustrated by FIGS. 5 through 8 which correspond to FIGS. 1 through 4 excepting that a plurality of the sheet metal pipe molds are illustrated. Because the parts are all the same, they are numbered the same as previously, the numerals being primed for separate identification in the case of FIGS. 5 through 8. In the practice of the invention, a larger number of the pipes can be used, positioned as a group within the sand container or barrel and interconnected by a common enlarged runner with the molten metal via a ceramic fountain as described before.

What is claimed is:

1. A method for casting molten metal to form ingots, comprising substantially vertically positioning in a container a plurality of sheet metal pipes with their bottoms interconnected by a runner and with the pipes in horizontally interspaced relation so as to form spaces therebetween, said container forming a space surrounding all of the pipes and said runner, filling all of said spaces solely with refractory particles so that said pipes and runner are embedded therein, covering the tops of said pipes and said container, bottom-pouring molten metal via said runner into said pipes so as to substantially fill said pipes and runner, inverting said containers while said metal remains molten, and allowing said metal to solidify while said container remains inverted.

2. The method of claim 1 in which after said metal solidifies said container is uncovered and said particles and ingots are dumped out from said container.

3. The method of claim 1 in which said runner is enlarged to form a reservoir of molten metal which when said container is inverted, is adequate by flowing downwardly to maintain said pipes filled with molten metal from the runner during the metal's solidification in the pipes.

4. The method of claim 1 in which said container is a sheet metal container.

5. The method of claim 1 in which said particles are fine-grained sand particles.

* * * * *